US007102588B1

(12) United States Patent
Phelan et al.

(10) Patent No.: US 7,102,588 B1
(45) Date of Patent: Sep. 5, 2006

(54) ANTENNA SYSTEM INCLUDING SWING ARM AND ASSOCIATED METHODS

(75) Inventors: Harry Richard Phelan, Palm Bay, FL (US); Russell E. Price, Palm Bay, FL (US); Kurt Zimmerman, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/110,388

(22) Filed: Apr. 20, 2005

(51) Int. Cl.
*H01Q 3/02* (2006.01)
*H01Q 3/10* (2006.01)

(52) U.S. Cl. ..... 343/882; 343/765; 343/766; 343/763; 343/757

(58) Field of Classification Search ..... 343/882, 343/765, 757, 763
See application file for complete search history.

(56) References Cited

U.S. PATENT DOCUMENTS

| | | | | |
|---|---|---|---|---|
| 3,202,015 | A | 8/1965 | Moul, Jr. et al. | 74/665 |
| 3,351,946 | A | 11/1967 | Verge | 343/705 |
| 3,383,081 | A | 5/1968 | Guttenberg | 248/346 |
| 4,282,529 | A | 8/1981 | Speicher | 343/765 |
| 4,392,140 | A | 7/1983 | Bastian et al. | 343/765 |
| 4,862,185 | A * | 8/1989 | Andrews et al. | 343/761 |
| 4,937,587 | A | 6/1990 | Tsuda | 343/765 |
| 5,359,337 | A * | 10/1994 | Eguchi | 343/765 |
| 6,259,415 | B1 | 7/2001 | Kumpfbeck et al. | 343/765 |
| 6,262,688 | B1 * | 7/2001 | Kasahara | 343/766 |
| 6,531,990 | B1 | 3/2003 | Verkerk | 343/882 |
| 6,764,051 | B1 | 7/2004 | Knight | 248/128 |
| 2003/0071759 | A1 | 4/2003 | Bien et al. | 343/757 |
| 2004/0150574 | A1 | 8/2004 | Harron | 343/765 |

* cited by examiner

*Primary Examiner*—Trinh Vo Dinh
(74) *Attorney, Agent, or Firm*—Allen, Dyer, Doppelt, Milbrath & Gilchrist, P.A.

(57) ABSTRACT

An antenna system may include a base having an opening therein, and a swing arm having a concave elongate shape and opposing ends pivotally connected to the base to permit a swinging motion of the swing arm within the opening in the base. A swing arm positioner may be connected between the swing arm and the base. The antenna system may also include an antenna carriage movable along the swing arm. An antenna carriage positioner may be connected between the antenna carriage and the swing arm. A positioning controller may be connected to the swing arm positioner and the antenna carriage positioner, and an antenna may be connected to the antenna carriage.

24 Claims, 5 Drawing Sheets

ANTENNA SYSTEM INCLUDING SWING ARM AND ASSOCIATED METHODS

FIELD OF THE INVENTION

The invention relates to the field of antenna systems, and, more particularly, to antenna systems and related methods.

BACKGROUND OF THE INVENTION

An antenna may have one or more beams that are desirably scanned over an area. The scanning can be accomplished by mechanical, electronic, or a combination of mechanical and electronic techniques. For example, U.S. Published Application No. 2003/0071759 to Bien et al. discloses an antenna positioner having a curved cradle with a gear track for adjusting the elevation of the antenna. The antenna positioner further includes a rotary plate connected to the curved cradle for rotating the antenna around an azimuth axis.

Similarly, U.S. Pat. No. 4,937,587 to Tsuda discloses a mechanical scan antenna system having a travel guide on which the antenna travels to permit scanning in one axis. The system also includes a rotatable mount for rotating the travel guide about an azimuth axis. U.S. Pat. No. 6,259,415 to Kumpfbeck et al. also discloses an antenna positioning system including a mount that rotates the antenna in the azimuth axis. The system further includes an elevation tilter for adjusting the horizontal axis position of the antenna.

U.S. Pat. No. 3,202,015 to Moul, Jr. et al.; U.S. Pat. No. 3,383,081 to Guttenberg; U.S. Pat. No. 3,351,946 to Verge; U.S. Pat. No. 4,282,529 to Speicher; U.S. Pat. No. 6,531,990 to Verkerk; U.S. Pat. No. 6,764,051 to Knight; and U.S. Published Application No. 2004/0150574 to Harron all disclose an antenna positioning system including an arcuate member having two ends and a drive track. The drive track engages, and is advanced across a drive unit thereby permitting the positioning of the arcuate member to be changed. These patents and published application systems further disclose the antenna being pivotally mounted on the two ends of the arcuate member.

Unfortunately, the conventional antenna positioning systems may be relatively large, complex, and expensive. This results in such systems requiring a large deployment footprint, increased maintenance and reliability problems, and fewer deployments due to cost considerations.

SUMMARY OF THE INVENTION

In view of the foregoing background, it is therefore an object of the invention to provide a more straightforward antenna system and that provides a smaller deployment footprint.

This and other objects, features, and advantages in accordance with the invention are provided by an antenna system that may include a base having an opening therein, and a swing arm having a concave elongate shape and opposing ends pivotally connected to the base to permit a swinging motion of the swing arm within the opening in the base. A swing arm positioner may be connected between the swing arm and the base, and an antenna carriage may be movable along the swing arm. An antenna carriage positioner may be connected between the antenna carriage and the swing arm. A positioning controller may be connected to the swing arm positioner and the antenna carriage positioner, and an antenna may be connected to the antenna carriage. Accordingly, the antenna system may be relatively straightforward and robust mechanically, and have a relatively compact overall size.

The swing arm may include a concave elongate body and a pair of mounting stubs extending outwardly from opposing ends thereof. The system may further comprise a pair of brackets carried by the base adjacent the opening therein for rotatably mounting the mounting stubs of the swing arm. Accordingly, the swing arm positioner may include a motor connected to one of the mounting stubs of the swing arm.

Furthermore, the swing arm may include a concave elongate body and a series of teeth on a surface thereof. The antenna carriage positioner may include a motor and at least one gear connected between the motor and the series of teeth. This permits accurate and robust control of the position of the antenna carriage.

The base may include sidewall portions connected together to enclose the swing arm. The antenna may be in the form of a planar antenna, such as a phased planar array antenna, for example. Alternately, the antenna may be in the form of a reflector antenna or other antenna configuration.

A method aspect of the invention is directed to mounting an antenna to a base having an opening therein. The method may include pivotally connecting opposing ends of a swing arm having a concave elongate shape to the base to permit a swinging motion of the swing arm within the opening in the base. A swing arm positioner may be connected between the swing arm and the base. The method may further include providing an antenna carriage carrying the antenna on the swing arm and being movable along the swing arm. The method may also include connecting an antenna carriage positioner between the antenna carriage and the swing arm.

DETAILED DESCRIPTION OF THE PREFERRED EMBODIMENTS

The invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
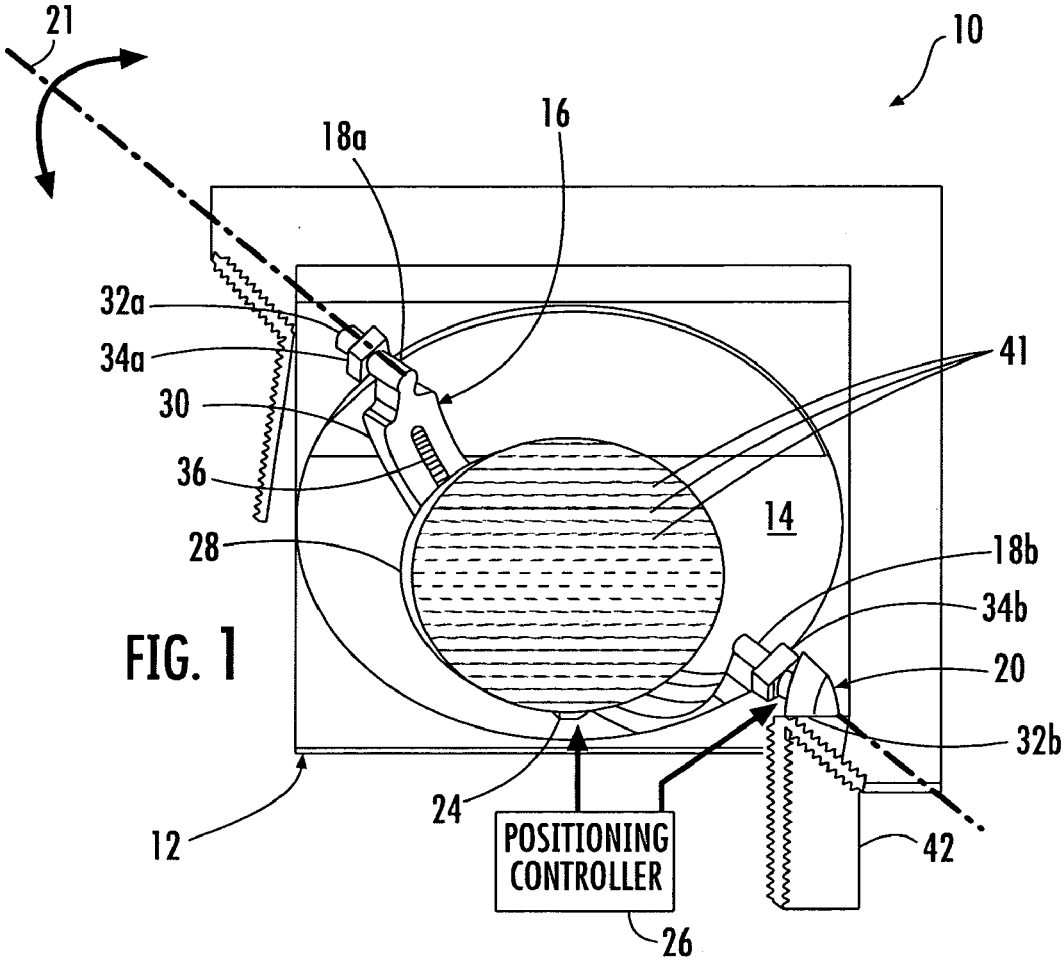
FIG. 1 is a schematic fragmentary top plan view of the antenna system in accordance with the invention with the antenna aimed in a first direction.
Figure 2:
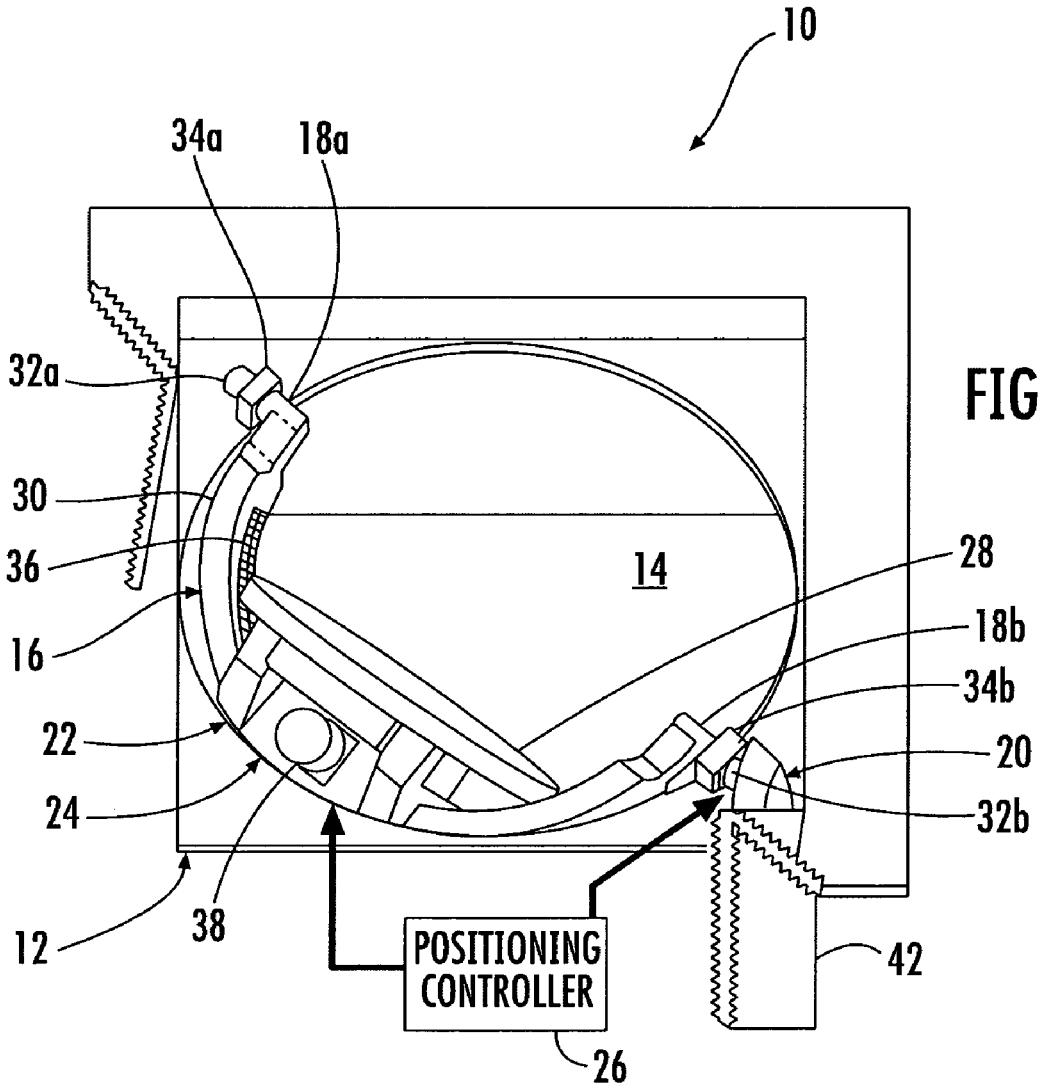
FIG. 2 is a schematic fragmentary top plan view of the antenna system of FIG. 1 with the antenna aimed in a second direction.
Figure 3:
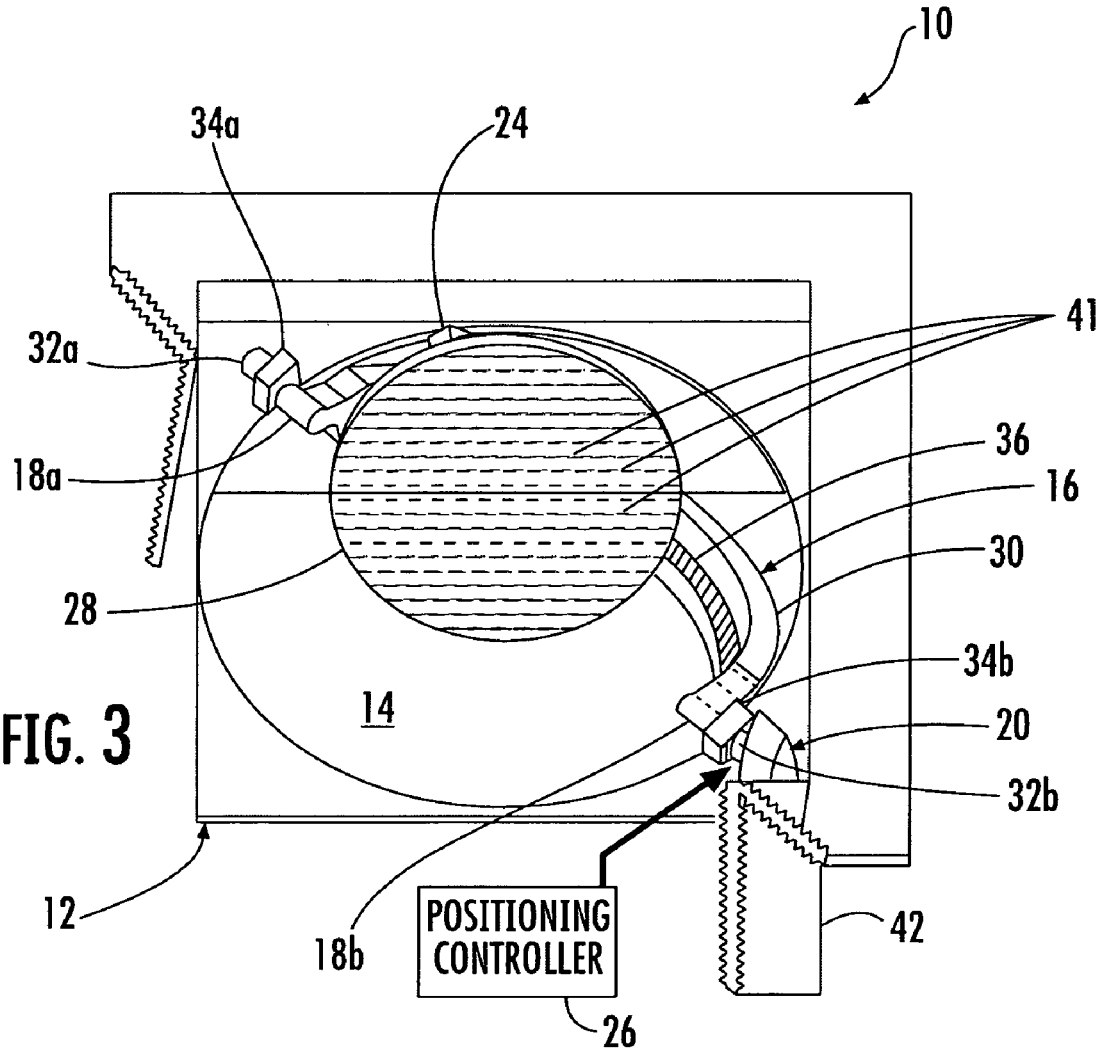
FIG. 3 is a schematic fragmentary top plan view of the antenna system of FIG. 1 with the antenna aimed in a third direction.

Referring initially to FIGS. 1–3, an antenna system 10 in accordance with the invention is now described. The antenna system 10 illustratively includes a base 12 having an opening 14 therein. A swing arm 16 having a concave elongate shape and opposing ends 18*a*, 18*b* is pivotally connected to the base 12 to permit a swinging motion of the swing arm within the opening in the base. The swinging motion of the swing arm 16 rotates on the axis indicated by the dashed line 21. The base 12 illustratively includes sidewall portions 42 connected together to enclose the swing arm 16. A swing arm positioner 20 is connected between the swing arm 16 and the base 12.

An antenna carriage 22 moves along the curved length of the swing arm 16. An antenna 28 is connected to an upper portion of the antenna carriage 22. An antenna carriage positioner 24 is connected between the antenna carriage 22 and the swing arm 16.

A positioning controller 26 is connected to the swing arm positioner 20 and the antenna carriage positioner 24, as will be appreciated by those skilled in the art. The positioning controller 26 may comprise a processor, logic circuit, or the like cooperating with the swing arm positioner 20 and the antenna carriage positioner 24 to control the positioning of the swing arm 16 and the antenna carriage 22 respectively.

The swing arm 16 comprises a concave elongate body 30 and a pair of mounting stubs 32*a*, 32*b* extending outwardly from opposing ends thereof. The antenna system 10 further illustratively comprises a pair of brackets 34*a*, 34*b* carried by the base 12 adjacent the opening 14 for rotatably mounting the mounting stubs 32*a*, 32*b* of the swing arm 16, as will be appreciated by those skilled in the art. The swing arm positioner 20 includes a motor connected to one of the mounting stubs 32*a*, 32*b* of the swing arm 16, for example. The motor could be an electric motor as will also be appreciated by those skilled in the art.

Figure 4:
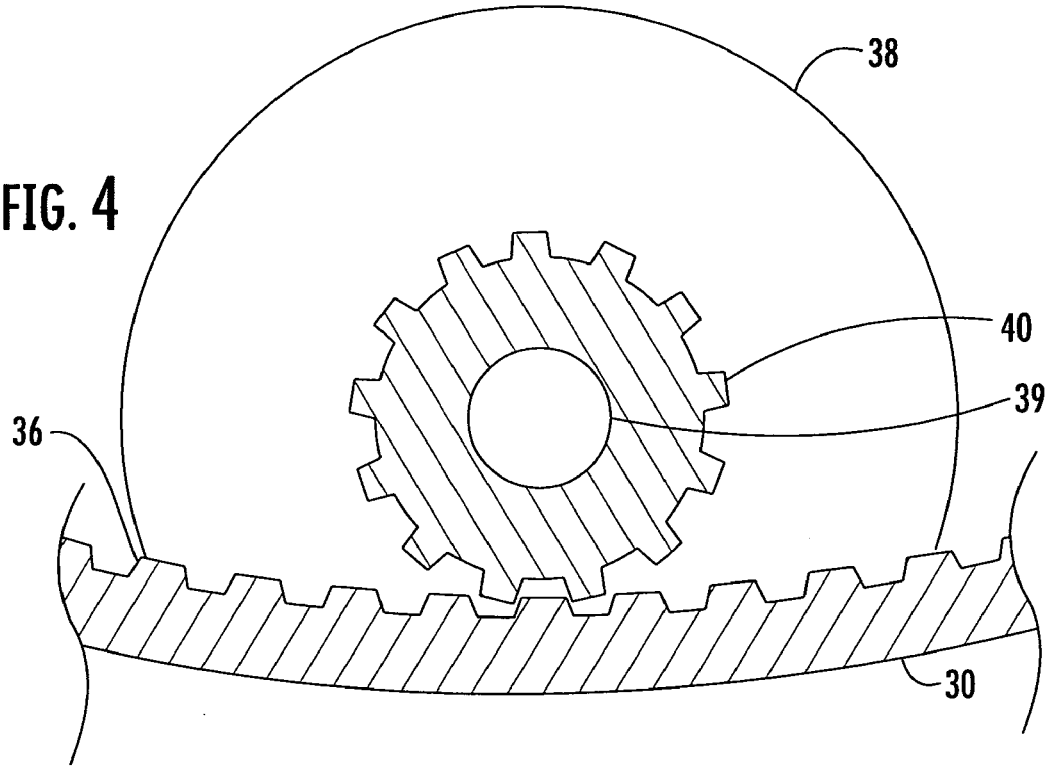
FIG. 4 is an enlarged schematic cross-sectional of a portion of the antenna system of FIG. 1 illustrating a series of teeth engaging a drive gear and motor.

Referring now additionally to FIG. 4, the swing arm 16 further includes a series of teeth 36 on a surface of the concave elongate body 30. This permits accurate and robust control of the position of the antenna carriage 22. The series of teeth 36 are illustrated as raised, however, the series of teeth may be recessed into the concave elongate body 30 or may have a different shape as will be appreciated by those skilled in the art.

The antenna carriage positioner 24 illustratively includes a motor 38 having an output shaft 39 and at least one gear 40 connected between the motor shaft and the series of teeth 36, for example. The gear 40 may be a pinion gear, double pinion gear, spring loaded split pinion gear, or worm gear although other gear configurations are possible as will be appreciated by those skilled in the art. Multiple gears and other drive configurations are also contemplated by the invention. As will be appreciated by those of skill in the art, other configurations of an antenna carriage positioner may include a curved liner motor, not shown, where the stator windings are un-wrapped and laid along the length of the concave elongate body 30. Alternately, a system of cables and pulleys, not shown, may be used to position the antenna carriage 22.

Figure 5:
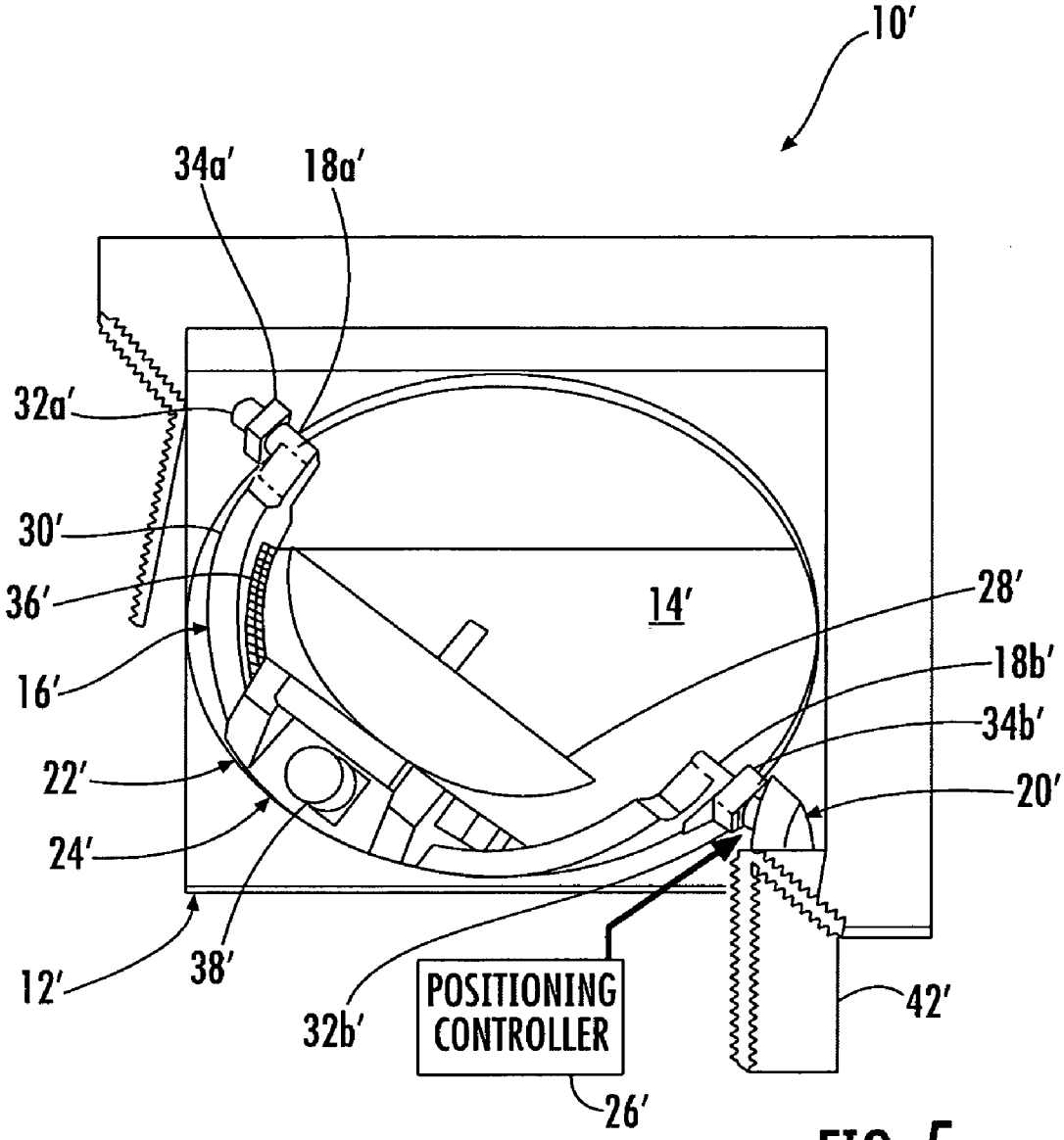
FIG. 5 is a schematic diagram of an alternate embodiment of the antenna system in accordance with the invention.

The antenna 28 is illustratively in the form of a planar antenna, and more particularly, in the form of a planar phased array antenna including a plurality of phased array elements 41. The phased array elements 41 may be selectively driven in amplitude and/or phase as will be appreciated by those skilled in that art. Alternately, referring additionally to FIG. 5, the antenna may be in the form of a reflector antenna 28' or any other antenna configuration as will be appreciated by those skilled in the art.

The positioning controller 26 is capable of positioning the antenna 28 by moving the swing arm 16, the antenna carriage 22, or by moving both the swing arm and the antenna carriage as illustrated in the exemplary positions shown in FIGS. 1–3. In FIG. 1, the positioning controller 26 has positioned the swing arm 16 in a first or bottommost position. In FIG. 2, the positioning controller 26 has positioned the swing arm 16 in a second or full upward left position. In FIG. 3 the positioning controller 26 has positioned the swing arm 16 in a third or partially upward right position, and has also adjusted the positioning of the antenna carriage 22 along to a far end of the swing arm. As a result, the aperture of the antenna 28 would scan different areas as will be appreciated by those skilled in the art.

A method aspect of the invention is directed to mounting an antenna 28 to a base 12 have an opening 14 therein. The method includes pivotally connecting opposing ends 18*a*, 18*b* of a swing arm 16 having a concave elongate shape to the base 12 to permit a swinging motion of the swing arm within the opening 14 in the base, and connecting a swing arm positioner 20 between the swing arm and the base. The method further includes providing an antenna carriage 22 carrying the antenna 28 on the swing arm 16 and being movable along the swing arm, and connecting an antenna carriage positioner 24 between the antenna carriage and the swing arm.

This antenna system 10 configuration when mounted within a cavity in a ground plane such as a ship, aircraft, land vehicle or other conducting platform may approach nearly the ideal minimum volume. This is because the antenna aperture, either planar array or reflector or other type, moves on a nearly ideal spatial arc in both spatial dimensions and the mechanical drive components take little extra space or volume as will be appreciated by those of skill in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that other modifications and embodiments are intended to be included within the scope of the appended claims.

That which is claimed is:

1. An antenna system comprising:

a base having an opening therein;

a swing arm having a concave elongate shape and opposing ends pivotally connected to said base to permit a swinging motion of said swing arm within the opening in said base;

a swing arm positioner connected between said swing arm and said base;

an antenna carriage movable along said swing arm;

an antenna carriage positioner connected between said antenna carriage and said swing arm;

a positioning controller connected to said swing arm positioner and said antenna carriage positioner; and an antenna connected to said antenna carriage.

2. The antenna system of claim 1 wherein said swing arm comprises a concave elongate body and a pair of mounting stubs extending outwardly from opposing ends thereof; and further comprising a pair of brackets carried by said base adjacent the opening therein and rotatably mounting said mounting stubs of said swing arm.

3. The antenna system of claim 2 wherein said swing arm positioner comprises a motor connected to one of said mounting stubs of said swing arm.

4. The antenna system of claim 1 wherein said swing arm comprises a concave elongate body and a series of teeth on a surface thereof; and wherein said antenna carriage positioner comprises a motor and at least one gear connected between said motor and said series of teeth.

5. The antenna system of claim 1 wherein said base comprises sidewall portions connected together to enclose said swing arm.

6. The antenna system of claim 1 wherein said antenna comprises a planar antenna.

7. The antenna system of claim 6 wherein said planar antenna comprises a phased array antenna.

8. The antenna system of claim 1 wherein said antenna comprises a reflector antenna.

9. An antenna positioning assembly for mounting an antenna to a base having an opening therein, the antenna positioning assemble comprising:

a swing arm having a concave elongate shape and opposing ends pivotally connected to the base to permit a swinging motion of said swing arm within the opening in the base;

a swing arm positioner connected between said swing arm and the base;

an antenna carriage for carrying the antenna and being movable along said swing arm; and an antenna carriage positioner connected between said antenna carriage and said swing arm.

10. The antenna positioning assembly of claim 9 further comprising a positioning controller connected to said swing arm positioner and said antenna carriage positioner.

11. The antenna positioning assembly of claim 9 wherein said swing arm comprises a concave elongate body and a pair of mounting stubs extending outwardly from opposing ends thereof; and further comprising a pair of brackets carried by the base adjacent the opening therein and rotatably mounting said mounting stubs of said swing arm.

12. The antenna positioning assembly of claim 11 wherein said swing arm positioner comprises a motor connected to one of said mounting stubs of said swing arm.

13. The antenna positioning assembly of claim 9 wherein said swing arm comprises a concave elongate body and a series of teeth on a surface thereof; and wherein said antenna carriage positioner comprises a motor and at least one gear connected between said motor and said series of teeth.

14. An antenna positioning assembly for mounting an antenna to a base having an opening therein, the antenna positioning assemble comprising:

a swing arm having a concave elongate shape and opposing ends pivotally connected to the base to permit a swinging motion of said swing arm within the opening in the base, said swing arm comprising a concave elongate body and a series of teeth on a surface thereof;

a swing arm positioner connected between said swing arm and the base;

an antenna carriage for carrying the antenna and being movable along said swing arm;

an antenna carriage positioner comprising a motor and at least one gear connected between said motor and said series of teeth; and a positioning controller connected to said swing arm positioner and said antenna carriage positioner.

15. The antenna positioning assembly of claim 14 wherein said swing arm comprises a concave elongate body and a pair of mounting stubs extending outwardly from opposing ends thereof; and further comprising a pair of brackets carried by the base adjacent the opening therein and rotatably mounting said mounting stubs of said swing arm.

16. A method of mounting an antenna to a base having an opening therein and comprising:

pivotally connecting opposing ends of a swing arm having a concave elongate shape to the base to permit a swinging motion of the swing arm within the opening in the base;

connecting a swing arm positioner between the swing arm and the base;

providing an antenna carriage carrying the antenna on the swing arm and being movable along the swing arm; and connecting an antenna carriage positioner between the antenna carriage and the swing arm.

17. The method of claim 16 further comprising connecting a positioning controller to the swing arm positioner and the antenna carriage positioner.

18. The method of claim 16 wherein the swing arm comprises a concave elongate body and a pair of mounting stubs extending outwardly from opposing ends thereof; and further comprising rotatably mounting the mounting stubs of the swing arm using a pair of brackets carried by the base adjacent the opening therein.

19. The method of claim 18 wherein the swing arm positioner comprises a motor connected to one of the mounting stubs of the swing arm.

20. The method of claim 16 wherein the swing arm comprises a concave elongate body and a series of teeth on a surface thereof; and wherein the antenna carriage positioner comprises a motor and at least one gear connected between the motor and the series of teeth.

21. The method of claim 16 wherein the base comprises sidewall portions connected together to enclose the swing arm.

22. The method of claim 16 wherein the antenna comprises a planar antenna.

23. The method of claim 22 wherein the planar antenna comprises a phased array antenna.

24. The method of claim 16 wherein the antenna comprises a reflector antenna.

* * * * *